United States Patent [19]

Sakai et al.

[11] 4,426,645

[45] Jan. 17, 1984

[54] CHARACTER GENERATING SYSTEM

[75] Inventors: Yuki Sakai, Hino; Hiroya Nakamura, Hachioji, both of Japan

[73] Assignee: Konishiroku Photo Industry Co., Ltd., Tokyo, Japan

[21] Appl. No.: 273,082

[22] Filed: Jun. 12, 1981

[30] Foreign Application Priority Data

Jun. 27, 1980 [JP] Japan ..... 55-86655

[51] Int. Cl.[3] ..... G09G 1/16

[52] U.S. Cl. ..... 340/724; 178/15; 340/750

[58] Field of Search ..... 340/724, 756, 749, 750; 178/15

[56] References Cited

U.S. PATENT DOCUMENTS 3,918,040 11/1975 Beuter et al. ..... 340/724
3,988,728 10/1976 Inoue et al. ..... 340/724 X
4,321,596 3/1982 Hernandez et al. ..... 340/724
4,323,892 4/1982 Kinghorn ..... 340/724

*Primary Examiner*—David L. Trafton
*Attorney, Agent, or Firm*—Jordan B. Bierman; Linda Bierman

[57] ABSTRACT

An arrangement for generating characters of relatively elongated vertical dimension and having a descender portion in a system wherein the character information is stored in read-only memory of substantially equal size for each of the characters to be generated, the upper portion of the elongated characters being stored in a primary read-only memory with all of the remaining characters and the descender portion of each elongated character being stored in a supplemental read-only memory. In displaying such an elongated character, the upper portion thereof is output from the primary read-only memory and the descender portion is output immediately thereafter from the supplemental read-only memory to form the character in composite form.

4 Claims, 4 Drawing Figures

CHARACTER GENERATING SYSTEM

BACKGROUND OF THE INVENTION

The present invention relates to character generating systems.

As output apparatus for a computer, an electronic printer and a character display are widely utilized. Various character generating systems therefor are known, including a charactron system wherein a character disk is placed in a cathode-ray tube and characters are generated by applying an electron beam thereto, a monoscope system wherein characters are prepared for scanning on the monoscope and are converted to image signals for display projection on the cathode-ray tube, a dot matrix system wherein characters to be displayed are divided into dots and thus displayed, and a stroke system wherein patterns of characters are stored in the form of vectors and are so formed for display. Among these systems, the dot matrix system, for example, inputs to the character generator the output from an information source—such as a central processing unit—and generates character signals there stored as a pattern of dots. The system for forming dot-based characters includes a character line scanning system wherein plural characters contained in the same line are scanned character line after character line, and a head scanning system wherein a head having plural dot generating elements successively forms the characters one after another.

It is important to realize that the range of characters to be displayed on the output apparatus can include katakana and Chinese characters as well as those of the Roman or English alphabet. In the case of the alphabet, one known displaying method, as shown in FIG. 1, provides for uppercase and lowercase letters (except j) to be displayed in an array defined by 32 lines longitudinal × 24 dots lateral, while a lowercase letter j is displayed with 42 lines longitudinal × 24 dots lateral. A space equivalent to 6 dots is allowed between each letter in the lateral direction; between each character line, a space equivalent to 22 lines is provided for uppercase letters and a space equivalent to 12 lines is placed between uppercase letters and the 5 lowercase letters g, j, p, q and y (hereinafter referred to as the "specific lowercase" or "descender" letters). According to this display method, 4 of the specific lowercase letters (excluding j) can be properly displayed by downwardly shifting them a distance equivalent to 10 lines so that the memory area needed to store such a letter is 32 lines longitudinal × 24 dots lateral. For the letter j, on the other hand, a memory area of 42 lines longitudinal × 24 dots lateral is required. As a consequence, accommodation of the lowercase letter j requires that the memory area for all of the letters be dimensioned to support a dot array of 42 lines longitudinal × 24 dots lateral, even though insofar as the remainder of the letters of the alphabet are concerned, the reserved memory area for 10 lines (42 lines − 32 lines) longitudinal × 24 dots lateral will not be used and is therefore wasted. Particularly with respect to character generators with high resolving power—as in the present example wherein a letter of the alphabet is displayed with 32 lines longitudinal × 24 dots lateral—the area corresponding to 10×24 dots is substantial and it is therefore necessary to utilize a memory element having a relatively large capacity. In order to avoid such a waste of memory area, one might consider storing even a lowercase letter j in a memory area of 32 lines longitudinal × 24 dots lateral. However, when an English or Roman letter is displayed by a conventional character generator with the use of character signals thus stored, the displayed letter has an unnatural appearance and the purpose and advantage of using a high resolution display method is lost. It is, for example, possible in such circumstances that an error in reading will be made due to illegibility of the displayed letter, and the noted arrangement has not therefore been regarded as perfectly satisfactory as an output apparatus for a computer or the like.

SUMMARY OF THE INVENTION

In view of the foregoing, the present invention divides the memory area for the lowercase letter j into a first portion of 32 lines longitudinal × 24 dots lateral and a second portion of 10 lines longitudinal × 24 dots lateral, as shown in FIG. 1. The first portion comprises a memory area dimensioned in the same manner as that for all of the remaining letters, and the second portion also comprises a memory area in the amount of one letter; both portions are simply combined to enable the display to show a single letter. Thus, the entire memory area for the letters need only be dimensioned to accommodate 32 lines longitudinal × 24 dots lateral and, as a result, memory area can be considerably saved and the lowercase letter j displayed has a natural and legible appearance that avoids the possibility of erroneous reading.

The novel features and advantages of the invention will become more apparent from the following detailed description of a preferred embodiment thereof when considered in conjunction with the accompanying drawings.

DETAILED DESCRIPTION OF THE PREFERRED EMBODIMENT

Figure 2:
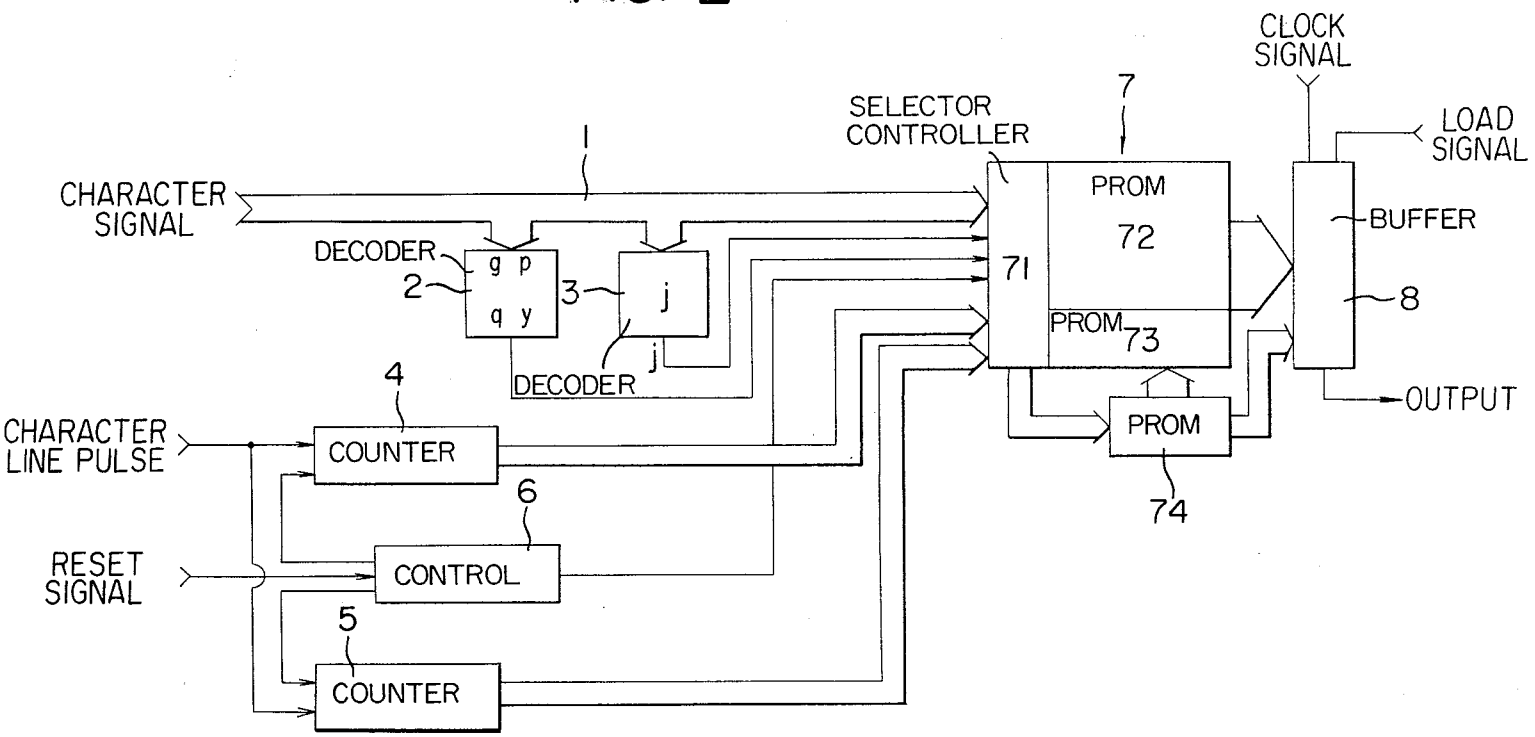
FIG. 2 is a circuit block diagram implementing the character generating system of the present invention.
Figure 3:
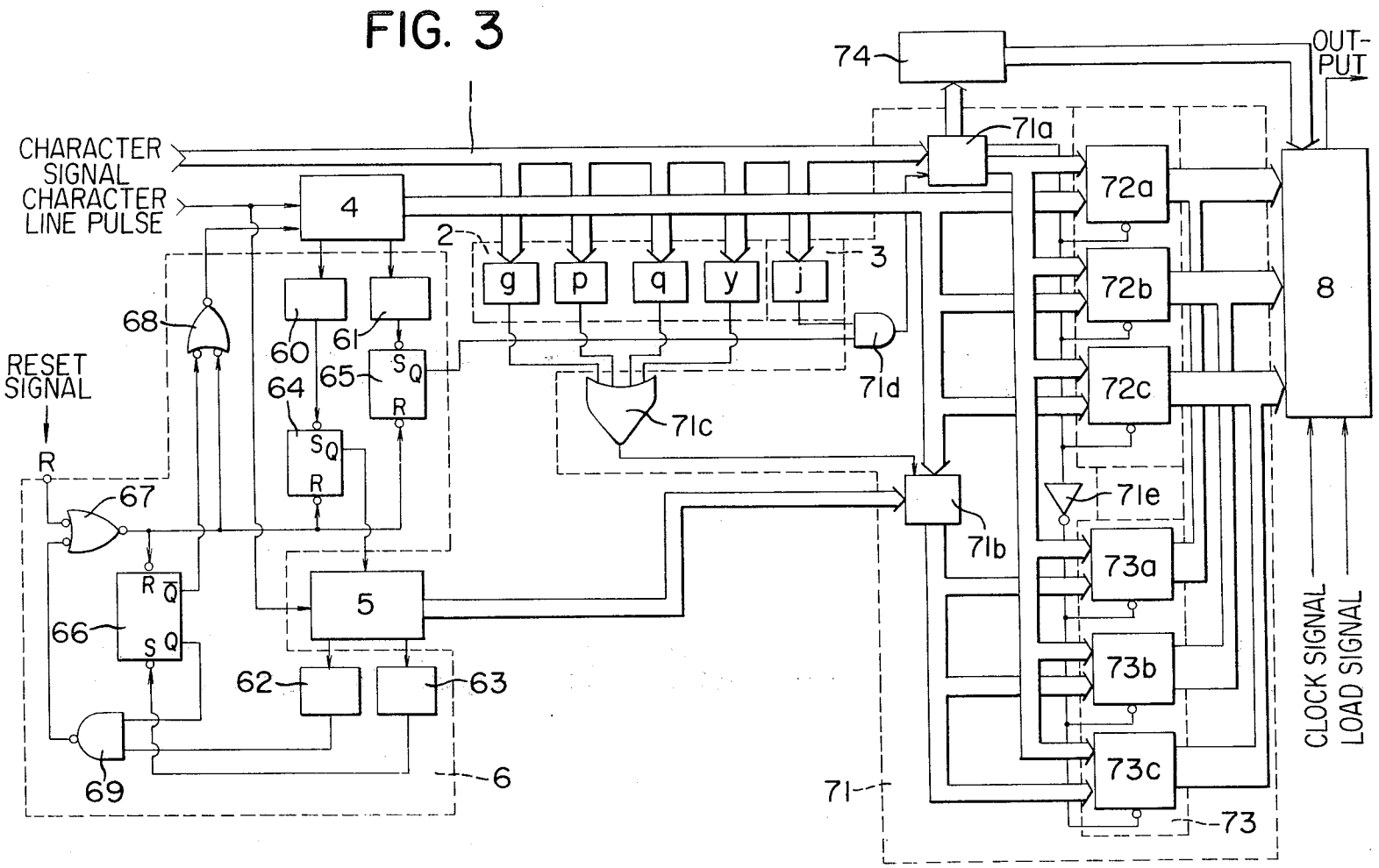
FIG. 3 is a more detailed block circuit diagram of the character generating circuit shown in FIG. 2.

FIG. 2 is a block diagram of a character signals generating circuit in accordance with the present invention, and FIG. 3 shows a more detailed construction of the circuit of FIG. 2.

Reference numeral 1 denotes a signal bus line that transmits information signals—including English letters encoded, for example, with a 7-bit ASCII code—generated from the central processing unit (not shown) of a computer or transmitted through a data communication transmission line. Numeral 2 designates a first decoder that detects and generates the specific lowercase letters g, p, q and y from information signals transmitted by signal bus line 1; it comprises an exclusive-OR circuit that detects the binary codes of the input letter signals (e.g., g=67H, p=70H, q=71H, and y=79H, where H denotes a hexadecimal number) and an AND circuit that takes a logical multiplication of its results. A second decoder 3 detects the code of and generates the lowercase letter j from information signals transmitted by signal bus line 1, and comprises an exclusive-OR circuit that detects coincidence of the input information signal with the binary code for the lowercase j (j=6AH) and an AND circuit connected thereto. Both a first counter 4 and a second counter 5 count the horizontal character line pulse number (up to 32) and generate the counted value in binary and, when the horizontal character line pulse number reaches 33, outputs a 1 and once more increments its output count by each input pulse. When 0 is input to the clear terminal of counter 4 or 5, its count is cleared; when a 1 is input, counting is enabled. A control circuit 6 causes counter 4 to count character line pulses first up to 32, and then from 1 to 10, and then to stop counting for 12 character line pulses which corresponds to the space between character lines (see FIG. 1). Control circuit 6 also causes counter 5 to start counting the character line pulses 10 pulses behind counter 4 and, after counter 5 counts from 1 to 32, it counts 12 character line pulses corresponding to the space between vertically adjacent lines; control circuit 6 then resets both counter 4 and counter 5.

Control circuit 6, as shown enclosed by dotted lines in FIG. 3, comprises a first detecting circuit 60 and a second detecting circuit 61, both connected to counter 4, a third detecting circuit 62 and a fourth detecting circuit 63, both connected to counter 5, three RS flip-flops 64, 65 and 66, and three gate circuits 67, 68 and 69. First through fourth detecting circuits 60, 61, 62 and 63—although not shown in detail—are each composed of an exclusive-OR circuit and a coincidence detecting circuit that generates an output when a predetermined binary value coincides with its input pulse count; in the present example the coincidence detectors of circuits 60, 61, 62 and 63 are set to detect the input pulse count 10, 32, 12 and 32, respectively.

Referring again to FIG. 2, a character generator 7 is composed of a selector controller 71 and PROM memories 72, 73 and 74. As shown in FIG. 3, selector controller 71 includes a selector 71*a* for connecting—by switching—the 8-bit signal bus line 1 to either memory group 72 or memory group 73, and a selector 71*b* for selecting either the 5-bit 32 character line pulse counting output transmitted from counter 4 or the 5-bit output transmitted from counter 5 and inputting the same to the addressing portion of each memory. Selector-controller 71 further includes a first gate 71*c* that receives the character signals from first decoder 2 (which detects the specific lowercase letters g, p, q and y and operates selector 71*b*), and a second gate 71*d*. Gate 71*d* generates an output when second decoder 3 detects a lower case j and a read time extension signal is generated from second RS flip flop 65 of controlcircuit 6; gate 71*d* causes selector 71*a* to extend the output time of memory group 72 from 32 character line pulses (equivalent) to 42 character line pulses (equivalent), and connects selector 71*a* to memory 74 and inverter 71*e* to divide an address of memory 72 and memory 73.

Any of memories 72, 73 and 74 may be composed of EEPROM. Memory 72 is shown as a group of memory blocks 72*a*, 72*b* and 72*c*; memory 73 is similarly depicted as blocks 73*a*, 73*b* and 73*c*. The address portion of each memory comprises 8 bit ASCII code, and the data portion comprises 24 bit dot signals of parallel output. Memory 72 contains the marks of characters (those whose 7th bit of ASCII code is zero) other than lowercase g, p, q and y, and the body portion of the lowercase j shown by the top 32 lines in FIG. 1. Memory 73 contains the marks of the lowercase characters g, p, q and y (those whose 7th bit of ASCII code is 1), and memory 74 (whose address portion is 7C (Hex) and whose data portion is 10 character lines × 24 dots equivalent) contains the tail portion of the lowercase j—i.e. the lowermost 10 lines shown in FIG. 1. A buffer circuit 8 receives the output of memories 72 and 73, with the aid of LOAD signals, and generates an output in accordance with input clock signals.

Figure 4:
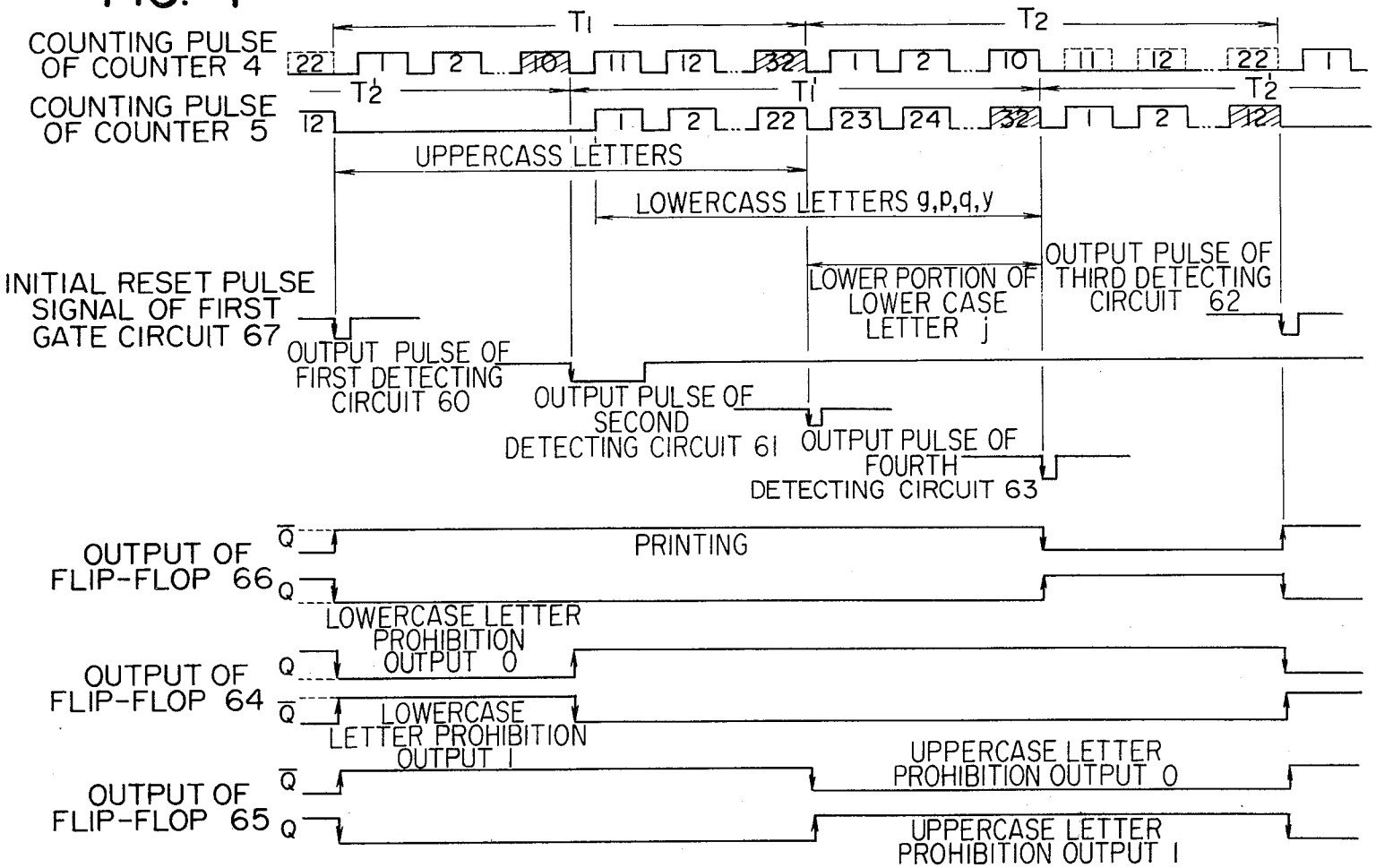
FIG. 4 is a timing diagram of signals in various portions of the circuit shown in FIG. 3.

The operation of the circuit of FIGS. 2 and 3 will now be explained with reference to FIG. 4, which represents a timing chart for the various signals present at certain points in the circuit.

When an initial reset pulse signal that changes from 1 to 0 is applied to the reset terminal R of control circuit 6—i.e. to the initial reset terminal of first gate circuit 67—first gate 67 is closed, the first, second and third RS flip flops 64, 65 and 66 are reset and second gate circuit 68 is opened. Consequently, the contents of counter 4 are cleard. When the reset pulse input to first gate circuit 67 returns from 0 to 1, first gate circuit 67 is opened and second gate circuit 68 is closed to thereby enable counter 4 for counting. Character line pulses now input to the H.SYN (H. Sync) terminal of counter 4 cause it to count successively from 1. When counter 4 completes the counting of 10 character line pulses, first detecting circuit 60 detects the rear or trailing edge of the 10th character line pulse and generates an output, setting first RS flip flop 64. As a consequence, a logic 1 is generated on the Q terminal of flip flop 64 and, owing to this output, counter 5 is cleared and enabled for counting which begins with the next inputted character line pulse. Thus, counter 5 generates and indicates a count which is always 10 character line pulses behind counter 4.

When second detecting circuit 61 detects that the counted value of counter 4 has reached 32, second RS flip flop 65 is set at the trailing edge of the 32nd character line pulse. Flip flop 65 then generates a logic 1 (a read time extension signal) at its Q terminal (see FIG. 4—uppercase letter prohibition output 1).

When third detecting circuit 62 detects that the counted value of counter 5 has reached 12, on the other hand, the output of detecting circuit 62 is applied to the NAND-implemented third gate circuit 69. At this point, however, third RS flip flop 66 is already reset, the output at its Q terminal is 0, and third gate circuit 69 is therefore closed. A logic 1 is accordingly applied to first gate circuit 67 which retains its state and continues to generate an ouput of logic 0. During this period, counter 5 continues to count and, when fourth detecting circuit 63 detects that the counted value has reached 32, third RS flip flop circuit 66 is set at the trailing edge of the 32nd pulse and a logic 1 is generated on its Q terminal; a logic 0 is correspondingly output at its Q terminal and is applied to one of the input terminals of second gate circuit 68. The other input terminal of second gate circuit 68 has already been reset with an input 1 such that the output of second gate circuit 68 becomes 0 and counting action of counter 4 accordingly stops. (Counter 4 remains disabled from counting until the output of first gate circuit 67 becomes 0, as hereinafter described.) The counting operation of counter 4 is suspended during the period from the 11th character line pulse to the 22nd character line pulse in its second counting cycle T2. (See FIG. 4, wherein T1 represents the first counting cycle of counter 4, T2 represents its second counting cycle, T1′ represents the first counting cycle of counter 5 and T2′ represents its second counting cycle.)

When the first counting cycle T1′ of character line pulses—that is, the counting period from the first to the 32nd character line pulse—input to counter 5 is completed, third gate detecting circuit 66 is set and its Q terminal is thereafter held at logic 1. The second counting cycle T2′ of counter 5 then begins and, when third detecting circuit 62 detects that its counted value has reached 12, a logic 1 is generated at the trailing edge of the 12th character line pulse and the output of third gate circuit 69 accordingly changes from logic 0 to logic 1. The output of first gate circuit 67 also changes from logic 1 to logic 0 and, as a result, the first, second and third RS flip flops 64, 65 and 66 are reset and the Q terminal output of each changes from logic 1 to logic 0. At the same time, the signal applied to one input terminal of second gate circuit 68 changes from logic 1 to logic 0 causing second gate 68 to generate a logic 1 and again enabling counter 4 for counting. At this time, counter 5 is cleared by a logic 0 on the Q terminal of first RS flip flop 64 and its counted value becomes 0. Counter 5 has therefore automatically returned to its initial state so that counting again begins from the character line pulses thereafter input.

The indication or output of characters will now be described by once more referring to FIG. 2.

When the reset signal is applied to reset terminal R of control circuit 6 by operating the manual reset button, counters 4 and 5 are simultaneously reset and thus returned to their initial state. The character signals (in ASCII code) successively transmitted through signal bus line 1 are input to first decoder 2, second decoder 3 and character generator 7. First decoder 2 comprises an Exclusive-OR circuit and generates a detection signal "g" if it detects any of the 4 specific lowercase letters g, p, q and y; second decoder 3 generates a detection signal "j" if it detects the specific lowercase letter j. The detection signals of decoders 2 and 3 are applied to selector controller 71 of character generator 7.

Counter 4 counts—beginning with the first—the character line pulses that are input simultaneously with the character signals. Counter 5, on the other hand, starts counting after a delay of 10 character line pulses with respect to counter 4 with the aid of control circuit 6, as directed by the Q terminal output of first RS flip flop 64. The counting outputs of both counters 4 and 5 (each being of 5 bits, 32 notation) are simutaneously input to selector controller 71 of character generator 7. With respect to those letters for which no detection signal "g" is generated—namely the uppercase letters and the lowercase letters other than g, p, q, y and the upper portion of the lowercase j—the dot signals are successively generated beginning with the first character line through buffer 8 from memory 72 of character generator 7 with the aid of the output of counter 4; these characters are normally and conventionally formed on a display device or an output device such as a printer.

As for those letters for which a detection signal "g" is generated—namely the specific lowercase letters g, p, q and y—counter 4 is not operated for the first through 10th character line pulses and, as a consequence, no dot signals are generated by character generator 7; it is not until the 11th character line pulse that dot signals for the first character line input are generated by the character generator. For the 11th character line pulses and thereafter, the appropriate addresses of memory 73 of character generator 7 are indicated with a delay of 10 positions and, consequently, the corresponding dot signals are generated by character generator 7 through buffer circuit 8 with a delay of 10 character line pulses (equivalent). In other words, the lowercase letters g, p, q and y are displayeds beginning with a position 10 character lines (equivalent) delayed or behind on the display device or printer.

As for the lowercase letter "j", after the 32nd chaacter line pulse is input memory 74 is connected by selector controller 71 to enable a pulse input thereto of 10 character lines (equivalent); the dot signals corresponding to the trailing portion of the lowercase "j" are thereby generated and the total "j" character thus completed using 42 character line pulses.

Particularly when employing character generators having a high resolving power, wherein a letter of the alphabet is displayed with a dot matrix of 32 longitudinal × 24 lateral (as above), the area corresponding to this 10×24 dot array is considerably broad and a memory cell of large memory capacity should accordingly be used. In order to avoid such waste in the memory area, the foregoing example provides for the specific lowercase letters of g, p, q and y to be displayed with a delay of 10 character lines; it should be understood, however, that the present invention relates strictly to the disclosed method of displaying the lowercase j and has no relation to the foregoing display method of the lowercase letters g, p, q and y, although from a practical point of view the disclosed method is desirable. In any event, it is within the scope and contemplation of the invention that the method of displaying a lowercase j be correspondingly applied to display the cedilla in French, various letters in the Persian, Arabic and Chinese alphabets, and other marks and symbols.

Figure 1:
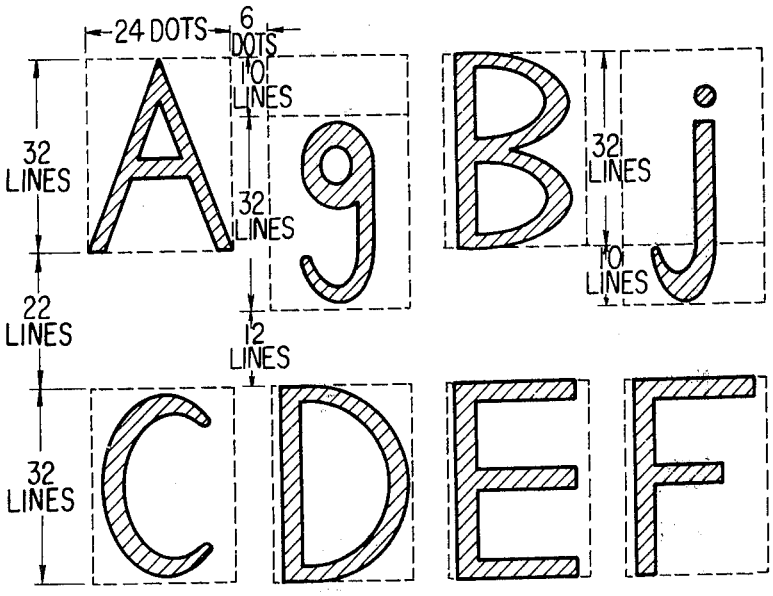
FIG. 1 represents an example of a conventional display method for English letters.

In accordance with the present invention, an English lowercase letter j or some other predetermined letter or character is detected from successively input information and, with the aid of this detection signal, a longer character signal generating period than that for other letters is provided so that the letter is properly and attractively displayed. Advantageously, when storing character signals in the character generator, the same memory area (32 character lines longitudinal × 24 dots lateral, for example), can be used for all of the letters—uppercase and lowercase—thereby notably and efficiently conserving memory capacity when compared to conventional memory means. In the illustration of FIG. 1, by way of example, almost a 25% reduction (10/42) in required memory capacity is realized by practice of the invention.

What is claimed is:

1. In a system for generating alphanumeric characters for display by electrical means in response to signals input to the system, a primary character store in which each of the different characters are stored in an equally dimensioned coordinate matrix of discreet character elements, a supplemental character store in which the lower descender portion of the lower case letter j is stored in a coordinate matrix of discreet character elements, means coupled to the primary and supplemental character stores for selecting characters to be output for display by electrical means in response to the input signals and for causing the character element data to be generated by row in sequence for each selected character, timing means coupled to said selecting means and said primary character store for enabling the output for display of the character elements for each character representing lower case letters g, p, q and y to be predeterminately delayed by said selecting means such that the lower case letters g, p, q and y appear as downwardly shifted with respect to other characters normally output for display, and decoding means coupled to the input signals and said selecting means for detecting the lower case letters g, p, q, y and j in the input signals and for causing said predetermined output delay upon detection of the lower case letters g, p, q and y and for causing, upon detection of the lower case letter j, the character elements thereof to be normally output from said primary character store and the character elements of the lower descender portion of the lower case letter j to be output immediately thereafter from said supplemental character store to complete a composite output for display of the lower case letter j.

2. In a system in accordance with claim 1, said primary and supplemental character stores each comprising a read-only memory device.

3. In a system for generating characters for display along a line defined on electrical means in response to signals input to the system, the generated characters comprising characters of a first type having a first vertical dimension and which are displayed totally above the line, characters of a second type having said first vertical dimension and which are displayed partly above and partly below the line, and characters of a third type having a second vertical dimension larger than said first dimension and which are displayed partly above and partly below the line, a primary character store in which each of the different characters of said first, second and third types are stored in an equally dimensioned coordinate matrix of discreet character elements, a supplemental character store in which a lower descender portion of each of the letters of said third type is stored in a coordinate matrix of discreet character elements, means coupled to the primary and supplemental character stores for selecting characters to be output for display by electrical means in response to the input signals and for causing the character element data to be generated by row in sequence for each selected character, timing means coupled to said selecting means and said primary character store for enabling the output for display of the character elements for each character of said second type to be predeterminately delayed by said selecting means such that the characters of said second type appear as downwardly shifted with respect to the characters of said first type output for display, and decoding means coupled to the input signals for detecting characters of said second and third types in the input signals for causing said predetermined output delay upon detection of characters of said second type and for causing, upon detection of characters of said third type, the character elements thereof to be normally output from said primary character store and the character elements of the lower descender portion thereof to be output immediately thereafter from said supplemental character store to complete a composite output of each character of said third type.

4. In a system in accordance with claim 3, said primary and supplemental character stores each comprising a read-only memory device.

* * * * *